US009309602B2

(12) United States Patent
Wolpers et al.

(10) Patent No.: US 9,309,602 B2
(45) Date of Patent: Apr. 12, 2016

(54) ELECTROLYTIC IRON METALLIZING OF ZINC SURFACES

(71) Applicant: HENKEL AG & CO. KGAA, Duesseldorf (DE)

(72) Inventors: Michael Wolpers, Erkrath (DE); Marcel Roth, Düsseldorf (DE); Jürgen Stodt, Neuss (DE); Andreas Arnold, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 326 days.

(21) Appl. No.: 13/795,528

(22) Filed: Mar. 12, 2013

(65) Prior Publication Data

US 2013/0206603 A1 Aug. 15, 2013

Related U.S. Application Data

(63) Continuation of application No. PCT/EP2012/060642, filed on Jun. 6, 2012.

(30) Foreign Application Priority Data

Jun. 29, 2011 (DE) ..... 10 2011 078 258

(51) Int. Cl.

| | |
|---|---|
| ***C23C 28/00*** | (2006.01) |
| ***C25D 3/20*** | (2006.01) |
| ***C25D 5/36*** | (2006.01) |
| ***C23C 22/78*** | (2006.01) |

(52) U.S. Cl.
CPC . *C25D 3/20* (2013.01); *C23C 22/78* (2013.01); *C25D 5/36* (2013.01)

(58) Field of Classification Search
CPC ..... C23C 28/00; C23C 28/32; C23C 28/321
USPC ..... 205/194, 196
See application file for complete search history.

(56) References Cited

U.S. PATENT DOCUMENTS

| | | | | |
|---|---|---|---|---|
| 3,974,044 | A | 8/1976 | Tremmel | |
| 4,089,754 | A * | 5/1978 | Tremmel et al. | 205/260 |
| 4,252,866 | A * | 2/1981 | Matsudo | C25D 5/10 205/176 |
| 5,298,289 | A | 3/1994 | Lindert et al. | |
| 2005/0282033 | A1 | 12/2005 | Nakamaru et al. | |

FOREIGN PATENT DOCUMENTS

| | | | | |
|---|---|---|---|---|
| DE | 3217145 | A1 * | 11/1983 | C23C 22/80 |
| DE | 19923084 | | 11/2000 | |
| JP | 63100184 | A * | 5/1988 | C23C 22/00 |
| JP | 07090610 | A * | 4/1995 | C23C 22/00 |
| WO | 9514117 | | 5/1995 | |
| WO | 0071626 | | 11/2000 | |
| WO | 2008135478 | | 11/2008 | |

OTHER PUBLICATIONS

International Search Report for PCT/EP2012/060642, dated Aug. 21, 2012, 3 pages.

* cited by examiner

*Primary Examiner* — Edna Wong
(74) *Attorney, Agent, or Firm* — Mary K. Cameron

(57) ABSTRACT

The present invention relates to a method for the metallizing pretreatment of galvanized and/or alloy-galvanized steel surfaces or joined metallic components having at least some zinc surfaces, wherein a thin surface layer of iron is deposited on the zinc surfaces from an aqueous electrolyte containing water-soluble compounds that are a source of iron cations. The method is performed at least partially or continuously under application of an electrolytic voltage, the galvanized and/or alloy-galvanized steel surfaces being connected as cathode. The aqueous electrolyte additionally contains an accelerator selected from oxo acids of the elements phosphorus, nitrogen and/or sulfur, the elements phosphorus, nitrogen and/or sulfur being present in moderate oxidation states.

14 Claims, No Drawings

ELECTROLYTIC IRON METALLIZING OF ZINC SURFACES

The present invention relates to a method for the metallizing pretreatment of galvanized and/or alloy-galvanized steel surfaces or joined metallic components having at least some zinc surfaces, wherein a thin surface layer of iron is deposited on the zinc surfaces from an aqueous electrolyte containing water-soluble compounds that are a source of iron cations. The method is performed at least partially or continuously under application of an electrolytic voltage, the galvanized and/or alloy-galvanized steel surfaces being connected as cathode. The aqueous electrolyte additionally contains an accelerator selected from oxo acids of the elements phosphorus, nitrogen and/or sulfur, the elements phosphorus, nitrogen and/or sulfur being present in moderate oxidation states.

Methods for metallizing galvanized and/or alloy-galvanized steel surfaces are known from the prior art. Thus WO 2008/135478 describes a pretreatment method for the currentless deposition of metallic coatings, in particular of iron and tin, on galvanized and/or alloy-galvanized steel surfaces. The pretreatment delivers moderately metallized zinc surfaces, which is advantageous for the application of subsequent anti-corrosive coatings and brings about outstanding edge protection. The deposition of iron preferably takes place here from aqueous compositions that additionally contain accelerators based on oxo acids of the elements phosphorus and/or nitrogen in moderate oxidation states. Practical experience of pretreatment has shown that the deposition of metallic coatings from such compositions leads to a significant accumulation of zinc ions in the pretreatment bath. At the same time, a sharp reduction in the effectiveness of the metal deposition is observed, which can be counteracted by adding further amounts of accelerator and metal cations for deposition. The object of the present invention is to keep the performance of the pretreatment bath stable over a longer period of time, where possible without having to add active components of the deposition bath.

This object is achieved by a method for the metallizing pretreatment of galvanized or alloy-galvanized steel surfaces, the galvanized or alloy-galvanized steel surface as cathode being brought into contact with an aqueous electrolyte whose pH is not greater than 9, wherein the aqueous electrolyte contains (a) at least one water-soluble compound that is a source for iron cations, the total concentration of such compounds being at least 0.001 mol/l relative to the element iron, (b) at least one accelerator selected from oxo acids of phosphorus, nitrogen or sulfur and salts thereof, at least one phosphorus, nitrogen or sulfur atom of the corresponding oxo acid being in a moderate oxidation state, and c) in total less than 10 ppm of electropositive metal cations selected from cations of the elements Ni, Co, Cu, Sn, the galvanized or alloy-galvanized steel surface being connected as cathode at least intermittently during the contact time with the aqueous electrolyte, a cathodic electrolytic current of at least 0.001 $mAcm^{-2}$, preferably at least 0.01 $mAcm^{-2}$, but not more than 500 $mAcm^{-2}$, preferably not more than 50 $mAcm^{-2}$, being applied to the galvanized or alloy-galvanized steel surface during this time.

The method according to the invention is suitable for all metal surfaces, for example strip steel, and/or joined metallic components consisting also at least in part of zinc surfaces, for example car bodies. Alloy-galvanized steel surfaces have the characterizing feature according to the invention that their surface exhibits more than 50 at % zinc relative to all metallic elements, the surface proportion of zinc being determined by X-ray photoelectron spectroscopy using aluminum K-alpha radiation (1486.6 eV).

Pretreatment within the meaning of this invention is understood to denote a process step for conditioning the cleaned metallic surface prior to passivation by means of inorganic barrier layers (e.g. phosphating, chromating) or prior to painting. Such a conditioning of the surface brings about an improvement in corrosion protection and paint adhesion for the entire coating system obtained at the end of an anti-corrosive surface treatment process chain.

The specified description of the pretreatment as "metallizing" denotes a pretreatment process that immediately brings about a metallic deposition of iron or an iron alloy on the zinc surface, wherein on completion of the metallizing pretreatment the pretreated metal surface consists of at least 50 at % iron relative to all metallic elements, the proportion of metallic iron being a least 50%, wherein the superficial surface layer and the metallic state can be determined by means of X-ray photoelectron spectroscopy (XPS) using aluminum K-alpha radiation (1486.6 eV).

The contact time or pretreatment duration with the aqueous electrolyte should preferably be at least 1 second but no longer than 60 seconds, preferably no longer than 20 seconds. The ratio of electrolysis duration to contact time should preferably be at least 0.5, particularly preferably at least 0.8.

In the method according to the invention the cathodic electrolytic current can be applied potentiostatically or galvanostatically, by means of pulses in each case, galvanostatic methods being preferred. It is preferable in particular for the galvanized or alloy-galvanized steel surface not to function as an anode during the contact time, so that no anodic electrolytic current is applied.

It has been found that metallization is particularly effective if the concentration of water-soluble compounds that are a source of iron cations is preferably at least 0.01 mol/l, relative to the element iron in the electrolyte, but preferably does not exceed 0.4 mol/l, particularly preferably 0.1 mol/l.

The water-soluble compounds are preferably a source of iron(II) ions and are thus preferably water-soluble salts selected from iron(II) sulfate, iron(II) nitrate, iron(II) lactate and/or iron(II) gluconate.

In this context it is further preferable for the iron ions in the electrolyte to comprise at least 50% iron(II) ions.

The accelerators having a reducing action that are included in the pretreatment method according to the invention to increase the deposition rate of the iron cations, in other words the metallization of the galvanized or alloy-galvanized surface, are preferably selected from oxo acids of phosphorus. Such oxo acids are in turn preferably selected from hyponitrous acid, hyponitric acid, nitrous acid, hypophosphoric acid, hypodiphosphonic acid, diphosphoric(III, V) acid, phosphonic acid, diphosphonic acid and/or phosphinic acid and salts thereof, particularly preferably from phosphinic acid and salts thereof.

The molar ratio of accelerator to the concentration of water-soluble compounds that are a source of iron cations in the aqueous electrolyte is preferably not greater than 2:1, particularly preferably not greater than 1:1, and is preferably not less than 1:5, the concentration of water-soluble compounds that are a source of iron cations being relative to the element iron.

The pH of the electrolyte should be preferably not less than 2 and preferably not greater than 6, so as on the one hand to minimize the acid corrosion of the zinc-containing substrate and on the other to ensure the stability of the iron(II) ions in the treatment solution.

To stabilize it, the electrolyte containing the water-soluble compounds of iron can further contain chelating complexing agents with oxygen and/or nitrogen ligands, wherein surprisingly a faster kinetics of iron deposition is observed, such that a shorter contact time with optimum iron coverage of the galvanized surface can be achieved.

Suitable chelating complexing agents are specifically those selected from triethanolamine, diethanolamine, monoethanolamine, monoisopropanolamine, aminoethylethanolamine, 1-amino-2,3,4,5,6-pentahydroxyhexane, N-(hydroxyethyl) ethylenediamine triacetic acid, ethylenediamine tetraacetic acid, diethylenetriamine pentaacetic acid, 1,2-diaminopropane tetraacetic acid, 1,3-diaminopropane tetraacetic acid, tartaric acid, ascorbic acid, lactic acid, mucic acid, gallic acid, gluconic acid and/or glucoheptonic acid and salts and stereoisomers thereof, as well as sorbital, glucose and glucamine and stereoisomers thereof.

The formulation of the aqueous electrolyte for the method according to the invention is particularly effective if it has a molar ratio of chelating complexing agents to concentration of water-soluble compounds that are a source of iron cations of not greater than 5:1, preferably not greater than 2:1, but at least 1:5, the concentration of water-soluble compounds that are a source of iron cations being relative to the element iron. Lower molar ratios than [ ] increase the deposition rate relative to the element iron only insignificantly. The same applies to higher molar ratios than 5:1, where there is a high proportion of free complexing agents.

The electrolyte for the metallizing pretreatment can moreover additionally contain surfactants, which can free the metallic surface from impurities without themselves inhibiting the surface for metallization by forming compact adsorbate layers. Non-ionic surfactants having average HLB values of at least 8 and at most 14 can preferably be used for this purpose.

In a preferred embodiment of the method according to the invention the electrolyte is substantially free from electropositive metal cations selected from cations of the elements Ni, Co, Cu and/or Sn, as these compete for deposition of the iron cations. In this context substantially free means that no water-soluble compounds that are a source of the electropositive metal cations are intentionally added to the electrolyte. The treatment according to the invention of alloy-galvanized steel surfaces containing electropositive metals as an alloy constituent or metallic surfaces in composite construction can result in small amounts of these elements finding their way into the electrolyte.

It is likewise preferable for the electrolyte in the method according to the invention to have less than 2000 ppm zinc ions, as in the presence of complexing agents, according to a preferred embodiment of the invention, zinc ions can drive the iron ions out of their complexes.

For the pretreatment method according to the invention, which represents part of the surface treatment process chain for galvanized and/or alloy-galvanized steel surfaces, a dipping method that is well-established in strip steel manufacture and refining is practicable.

In the execution according to the invention of the method it is preferable for surface layers of preferably at least 1 $mg/m^2$ but preferably not more than 100 $mg/m^2$ and particularly preferably not more than 50 $mg/m^2$ relative to the element iron to be obtained. Within the meaning of the present invention the surface layer is defined as the surface-related proportion of iron on the galvanized or alloy-galvanized steel surface immediately after the pretreatment according to the invention.

The pretreatment method according to the invention is adjusted to the subsequent process steps for the surface treatment of galvanized and/or alloy-galvanized steel surfaces in terms of optimized corrosion protection and outstanding paint adhesion, in particular on cut edges, surface defects and bimetal contacts. Consequently the present invention encompasses various aftertreatment methods, in other words conversion and paint coatings, which in conjunction with the pretreatment described above deliver the desired results in terms of corrosion protection.

A further aspect of the invention therefore relates to the production of a passivating conversion coating on the metallization-pretreated galvanized and/or alloy-galvanized steel surface with or without an intermediate rinsing and/or drying step.

A chromium-containing or preferably chromium-free conversion solution can be used for this purpose. Preferred conversion solutions with which the metal surfaces pretreated according to the present invention can be treated prior to application of a permanently anti-corrosive organic coating can be taken from DE-A-199 23 084 and the literature cited therein. According to this teaching a chromium-free aqueous conversion agent can contain as further active ingredients, in addition to hexafluoro anions of Ti, Si and/or Zr: phosphoric acid, one or more compounds of Co, Ni, V, Fe, Mn, Mo or W, a water-soluble or water-dispersible film-forming organic polymer or copolymer and organophosphonic acids having complexing properties. A full list of organic film-forming polymers that can be contained in the cited conversion solutions can be found on page 4 of this document, lines 17 to 39.

Thereafter this document discloses a very comprehensive list of complexing organophosphonic acids as further possible components of the conversion solutions. Specific examples of these components can be taken from the cited DE-A-199 23 084.

Furthermore, water-soluble and/or water-dispersible polymeric complexing agents with oxygen and/or nitrogen ligands based on Mannich addition products of polyvinyl phenols with formaldehyde and aliphatic amino alcohols can be included. Such polymers are disclosed in U.S. Pat. No. 5,298,289.

The process parameters for a conversion treatment within the meaning of this invention, such as for example treatment temperature, treatment duration and contact time, should be chosen such that a conversion coating is produced that, per $m^2$ of surface area, contains at least 0.05, preferably at least 0.2, but not more than 3.5, preferably not more than 2.0 and particularly preferably not more than 1.0 mmol of the metal M that is the substantial component of the conversion solution. Examples of metals M are Cr(III), B, Si, Ti, Zr, Hf. The coating density of the zinc surface with the metal M can be determined by means of an X-ray fluorescence method, for example.

In a particular aspect of a method according to the invention encompassing a conversion treatment following the metallizing pretreatment, the chromium-free conversion agent additionally contains copper ions. The molar ratio of metal atoms M selected from zirconium and/or titanium to copper atoms in such a conversion agent is preferably chosen such that it produces a conversion coating in which at least 0.1 mmol, preferably at least 0.3 mmol, but not more than 2 mmol of copper are additionally included.

The present invention therefore also relates to a method (IIa) that encompasses the following process steps including the metallizing pretreatment and a conversion treatment of the galvanized and/or alloy-galvanized steel surface:

i) optional cleaning/degreasing of the material surface ii) metallizing pretreatment with an aqueous agent (1) according to the present invention iii) optional rinsing and/or drying step iv) chromium(VI)-free conversion treatment in which a conversion coating is produced that, per $m^2$ of surface area, contains 0.05 to 3.5 mmol of the metal M that is the substantial component of the conversion solution, the metals M being selected from Cr(III), B, Si, Ti, Zr, Hf.

As an alternative to a method in which the metallizing pretreatment is followed by a conversion treatment with formation of a thin amorphous inorganic coating, a method can also be used in which the metallization according to the invention is followed by a zinc phosphating with formation of a crystalline phosphate layer having a preferred coating weight of not less than 3 $g/m^2$.

Furthermore, the metallizing pretreatment and subsequent conversion treatment are conventionally followed by further process steps for the application of additional coatings, in particular organic paints or paint systems.

A further aspect of the present invention relates to the galvanized and/or alloy-galvanized steel surface and the metallic component, which consists at least in part of a zinc surface, which undergoes a metallizing pretreatment in the aqueous electrolyte by the method according to the invention or following this pretreatment is coated with further passivating conversion coatings and/or paints.

A steel surface or component treated in such a way is used in body construction in automotive manufacturing, in shipbuilding, in the construction industry and for the manufacture of white goods.

What is claimed is:

1. A method for metallizing pretreating galvanized or alloy-galvanized steel surfaces, comprising:

contacting a galvanized or alloy-galvanized steel surface with an aqueous electrolyte, whose pH value is not greater than 9, wherein the aqueous electrolyte contains:

(a) at least one water-soluble compound which is a source of cations of the element iron, wherein the total concentration of the at least one water-soluble compound is at least 0.001 mol/l relative to the element iron, (b) at least one accelerator selected from oxoacids of phosphorus, oxoacids of nitrogen, oxoacids of sulfur, salts of oxoacids of phosphorus, salts of oxoacids of nitrogen, salts of oxoacids of sulfur, and combinations thereof, wherein at least one of phosphorus, nitrogen, or sulfur atom of the oxoacids is present in an intermediate oxidation state, and (c) a total of less than 10 ppm of electro-positive metal cations selected from cations of elements Ni, Co, Cu, and Sn, wherein during a time of contact with the aqueous electrolyte, the galvanized or alloy-galvanized steel surface is switched for a period of the time of contact, at least temporarily to a cathode, wherein in this period, a cathodic electrolysis current in a range of 0.001 to 500 $mA/cm^2$ is imparted to the galvanized or alloy-galvanized steel surface.

2. The method according to claim 1, wherein the at least one water-soluble compound which is a source of iron cations is present in the electrolyte in a total concentration of at least 0.01 mol/l relative to the element iron but does not exceed a total concentration in the electrolyte of 0.4 mol/l, relative to the element iron.

3. The method according to claim 1 wherein at least 50% of the iron cations are iron(II) cations.

4. The method according to claim 1 wherein the pH of the electrolyte is not less than 2 and not greater than 6.

5. The method according to claim 1 wherein the aqueous electrolyte additionally contains at least one chelating complexing agent with oxygen and/or nitrogen ligands.

6. The method according to claim 5, wherein the chelating complexing agents are selected from triethanolamine, diethanolamine, monoethanolamine, monoisopropanolamine, aminoethylethanolamine, 1-amino-2,3,4,5,6-pentahydroxyhexane, N-(hydroxyethyl)ethylenediamine triacetic acid, ethylenediamine tetraacetic acid, diethylenetriamine pentaacetic acid, 1,2-diaminopropane tetraacetic acid, 1,3-diaminopropane tetraacetic acid, ascorbic acid, tartaric acid, lactic acid, mucic acid, gluconic acid, glucoheptonic acid, sorbital, glucose, glucamine; stereoisomers thereof; and salts thereof.

7. The method according to claim 5, wherein a molar ratio of the chelating complexing agents to the iron cations is not greater than 5:1, but is at least 1:5.

8. The method according claim 1, wherein the aqueous electrolyte contains no more than 2000 ppm of zinc ions.

9. The method according to claim 1, wherein after contacting the galvanized or alloy-galvanized steel surface with the aqueous electrolyte, a metallic coating is present on the galvanized or alloy-galvanized steel surface in a coating thickness of at least 1 $mg/m^2$ relative to the element iron but no more than 100 $mg/m^2$ relative to the element iron.

10. The method according to claim 9, wherein after contacting the galvanized or alloy-galvanized steel surface with the aqueous electrolyte thereby forming a metallizing pretreated galvanized or alloy-galvanized steel surface, a passivating conversion treatment of the metallizing pretreated galvanized or alloy-galvanized steel surface takes place, with or without an intermediate rinsing and/or drying step.

11. The method according to claim 10, further comprising additional subsequent process steps for application of additional coatings selected from conversion coatings, organic paints, paint systems and combinations thereof.

12. The method of claim 10, wherein the passivating conversion treatment is a chromium-free conversion treatment.

13. The method of claim 1, wherein cations of the element iron are present in the aqueous electrolyte at a concentration of 0.01 mol/l to 0.1 mol/l.

14. The method of claim 1, wherein the oxoacids are selected from the group consisting of hyponitrous acid, hyponitric acid, nitrous acid, hypophosphoric acid, hypodiphosphonic acid, diphosphoric (III, IV) acid, phosphonic acid, diphosphinic acid, salts thereof, and mixtures thereof.

* * * * *